US005876129A

United States Patent [19]

Suzuki

[11] Patent Number: 5,876,129

[45] Date of Patent: Mar. 2, 1999

[54] THERMAL LINE PRINTER WITH CARRIAGE ROLLER CONTACTING THE PLATEN

[75] Inventor: Minoru Suzuki, Tokyo, Japan

[73] Assignee: Asahi Kogaku Kogyo Kabushiki Kaisha, Tokyo, Japan

[21] Appl. No.: 873,017

[22] Filed: Jun. 11, 1997

[30] Foreign Application Priority Data

Jun. 14, 1996 [JP] Japan ..... 8-175780

[51] Int. Cl.[6] ..... B41J 13/03

[52] U.S. Cl. ..... 400/120.01; 400/636; 347/218

[58] Field of Search ..... 400/120.01, 120.04, 400/636, 648; 347/218, 219

[56] References Cited

U.S. PATENT DOCUMENTS

| | | | |
|---|---|---|---|
| 4,447,818 | 5/1984 | Kurata et al. | 347/218 |
| 4,583,127 | 4/1986 | Kurata et al. | 347/218 |
| 4,910,530 | 3/1990 | Fukumoto et al. | 347/219 |
| 4,966,476 | 10/1990 | Kuzuya et al. | 400/208 |
| 5,013,170 | 5/1991 | Haftmann et al. | 400/659 |
| 5,063,395 | 11/1991 | Nuita et al. | 346/76 |
| 5,160,944 | 11/1992 | Fukumoto et al. | 347/219 |
| 5,399,031 | 3/1995 | Whritenor | 400/120.04 |
| 5,468,080 | 11/1995 | Jones | 400/618 |
| 5,645,361 | 7/1997 | Mitsushima et al. | 400/636 |
| 5,645,362 | 7/1997 | Aizawa et al. | 400/642 |
| 5,703,635 | 12/1997 | Sasaki et al. | 347/176 |

FOREIGN PATENT DOCUMENTS 8-174930 7/1996 Japan .

*Primary Examiner*—Ren Yan
*Assistant Examiner*—Daniel J. Colilla
*Attorney, Agent, or Firm*—Greenblum & Bernstein, P.L.C.

[57] ABSTRACT

A thermal line printer in which characters or image data are printed on a recording paper using a thermal line head having an array of heat generating resistors is provided. A platen roller opposed to the thermal line head presses the recording paper between the platen roller and the thermal line head. A carriage roller which is provided in close proximity to the thermal line head. A drive motor rotates the carriage roller. A spring biases the platen roller with respect to the thermal line head and the carriage roller. The recording paper is pressed at a predetermined pressure between the platen roller and the thermal line head. The recording paper is fed to pass through a passageway defined between the thermal line head and the platen roller in accordance with the rotation of the carriage roller.

30 Claims, 6 Drawing Sheets

THERMAL LINE PRINTER WITH CARRIAGE ROLLER CONTACTING THE PLATEN

BACKGROUND OF THE INVENTION

1. Field of the Invention

The present invention relates to a thermal line printer in which characters are printed on a recording paper, using a thermal line head having an array of heat generating elements.

2. Description of the Related Art

In a known thermal line printer, an entire line is printed on a recording paper such as a heat sensitive paper, in a single operation by means of a thermal line head which is comprised of a line of heat generating elements (e.g., resistors). The structure of a known thermal line printer is shown in FIG. 7 by way of example.

In FIG. 7, a conventional printer 100 includes a thermal line head 101 which has a plurality of heat generating resistors arranged along a line parallel to the printing paper and substantially perpendicular to the feeding direction of the printing paper, and a platen roller 102 opposed to the thermal line head 101. The thermal line head 101 and the platen roller 102 are housed in a body casing 100*a* which extends in a direction substantially perpendicular to the surface of the recording paper.

The recording paper, which is inserted in the printer 100 through an insertion opening 103 formed at the upper portion of the printer body, pressed at a predetermined pressure by and between the thermal line head 101 and the platen roller 102 and thereafter advanced in accordance with the rotation of the platen roller 102.

To press the printing paper at a desired pressure for the printing operation, the thermal line head 101 is swingable or rotatable about a shaft 101*b* (indicated by a dotted line) and is continuously biased by a spring 107 toward the platen roller 102.

Attempts have recently been made to make the thermal line printer thinner to thereby enable a user to carry the same in a bag or a briefcase, etc. As can be seen in FIG. 7, since the platen roller 102 is opposed to the thermal line head 101 in the direction corresponding to the thickness of the printer body, it is necessary to reduce the diameter of the platen roller in order to make the thermal line printer thinner.

The platen roller 102 includes a rigid core and a resilient cover made of a rubber material or the like, which surrounds the core to obtain a frictional force necessary to convey the printing paper together with the thermal line head 101. Therefore, if the diameter of the platen roller 102 is reduced, the diameter of the core is also reduced. However, the decrease in the diameter of the core of the platen roller causes the platen roller to tend to deflect when it is pressed. Thus, the diameter of the platen roller 102 has a minimal size, making it difficult to make the thermal line printer thinner.

SUMMARY OF THE INVENTION

It is an object of the present invention to provide a thin thermal line printer.

To achieve the object mentioned above, according to the present invention, there is provided a thermal line printer in which characters or image data are printed on a recording paper using a thermal line head having an array of heat generating elements. A platen roller opposed to the thermal line head presses the thermal line head. A carriage roller which is provided close to the thermal line head and contacts the platen roller. A drive mechanism drives the carriage. According to an aspect of the invention, the recording paper is fed through a passageway defined between the thermal line head and the platen roller in accordance with the rotation of the carriage roller by the drive mechanism.

With this arrangement, movement of the recording paper is chiefly carried out by the carriage roller, while the platen roller mainly presses the recording paper. Consequently, it is not necessary to make the platen roller with a high coefficient of friction (e.g., rubber). Namely, it is possible to make the platen roller of a hard plastic or the like, and hence, the diameter of the platen roller can be reduced without deflection problems. Moreover, it is not necessary to dispose the carriage roller opposed to the thermal line head. This arrangement also makes it possible to make the thermal line printer smaller.

In an embodiment, the recording paper passes through a passageway defined between the carriage roller and the platen roller. Consequently, the recording paper on which characters have been printed by the thermal line head can be conveyed and discharged by the platen roller and the carriage roller. Thus, the smooth and certain movement of the recording paper can be ensured.

The carriage roller is located downstream of the thermal line head in the feeding direction of the recording paper. The center of rotation of the carriage roller is located on the same side as the thermal line head with respect to a tangential line to the platen roller at a point closest to the thermal line head. With this structure, the leading end of the recording paper which has passed the passageway defined between the platen roller and the thermal line head comes into contact with the carriage roller at a relatively small angle (in a side view), so that the recording paper can be smoothly fed.

Preferably, the coefficient of friction of the surface of the platen roller is smaller than that of the surface of the carriage roller. Consequently, the grip force of the carriage roller to hold the recording paper is stronger than that of the platen roller. Thus, the conveyance of the recording paper is chiefly carried out by the carriage roller, so that no irregular conveyance of the recording paper takes place. If the friction coefficient of the surface of the platen roller is set at a small value, the friction resistance between the platen roller and the thermal line head can be reduced even if there is no recording paper therebetween. Consequently, the drive torque of the drive motor can be reduced accordingly.

A biasing mechanism can include at least one spring member which abuts against and presses the surface of the platen roller. With this arrangement, the platen roller can be biased by a simple structure.

The platen roller can be held by a swing cover which is swingable with respect to the printer body. The swing cover can be comprised of a pair of side plates which are each provided with an elongated hole which extends in a direction in which the swing cover moves close to or away from the thermal line head and the carriage roller. The platen roller can also be provided with a support shaft which is fitted in the elongated holes.

The swing cover can be provided, on one end thereof located on a downstream side, with a pivot shaft. The platen roller may be located on an upstream side in the direction of the movement of the recording paper, with respect to the pivot shaft. With this structure, when the swing cover is opened, a large space is established between the platen roller and the thermal line head, so that the recording paper can be easily removed upon the occurrence of a paper jam.

The biasing mechanism can include at least one spring member which is secured at one end to the swing cover and which abuts against the surface of the platen roller at the other end. Preferably, an insertion opening through which the recording paper is inserted in the printer and a guide member provided between the thermal line head and the insertion opening to guide the recording paper to the thermal line head are provided.

It is possible to provide a detecting mechanism for detecting the passing of the recording paper through the guide member.

The present disclosure relates to the subject matter contained in Japanese Patent Application No. 08-175780 (filed on Jun. 14, 1996), and which is expressly incorporated herein by reference in its entirety.

BRIEF DESCRIPTION OF THE DRAWINGS

The invention will be discussed below in detail with reference to the accompanying drawings, in which.

DESCRIPTION OF THE PREFERRED EMBODIMENT

Figure 1:
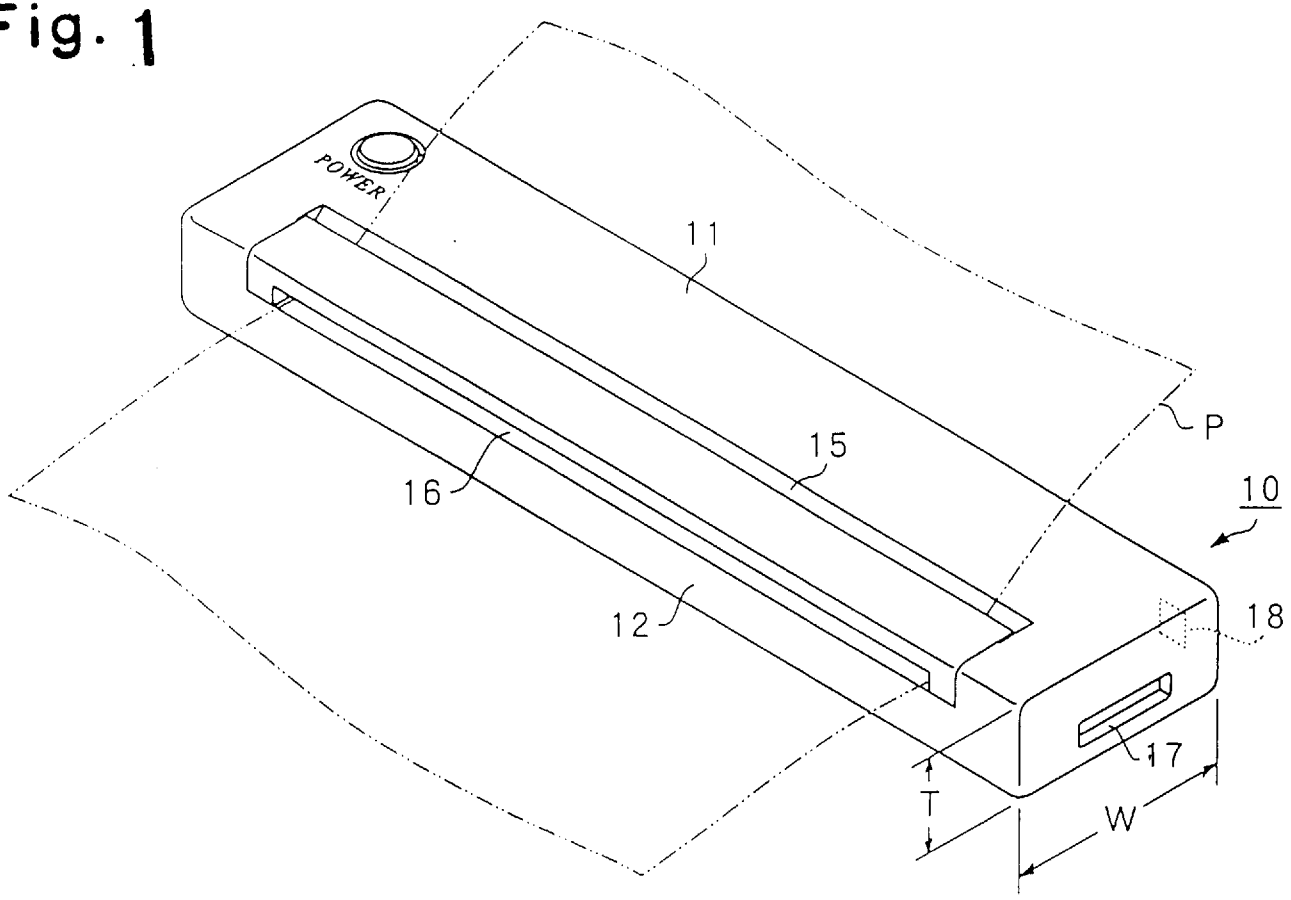
FIG. 1 is a perspective view of a thermal line printer according to the present invention.

In FIG. 1, which shows a perspective view of a thermal line printer according to the present invention, the thermal line printer 10 is, in the form of an elongated rectangle. The thickness T of the printer 10 is less than one-half the width W thereof.

The printer 10 is provided on the upper surface 11 thereof with an insertion opening 15 through which a recording paper P (such as a heat sensitive paper) is inserted, and on the front surface 12 with a discharge opening 16 through which the printed paper P is discharged. The printer is also provided on a side surface thereof with a terminal 17 to which an external device such as a computer can be connected to input image data. The power is supplied to the printer through a power source terminal 18 (indicated by dotted lines) provided on a rear surface of the printer and connected to the power source (not shown).

Figure 2:
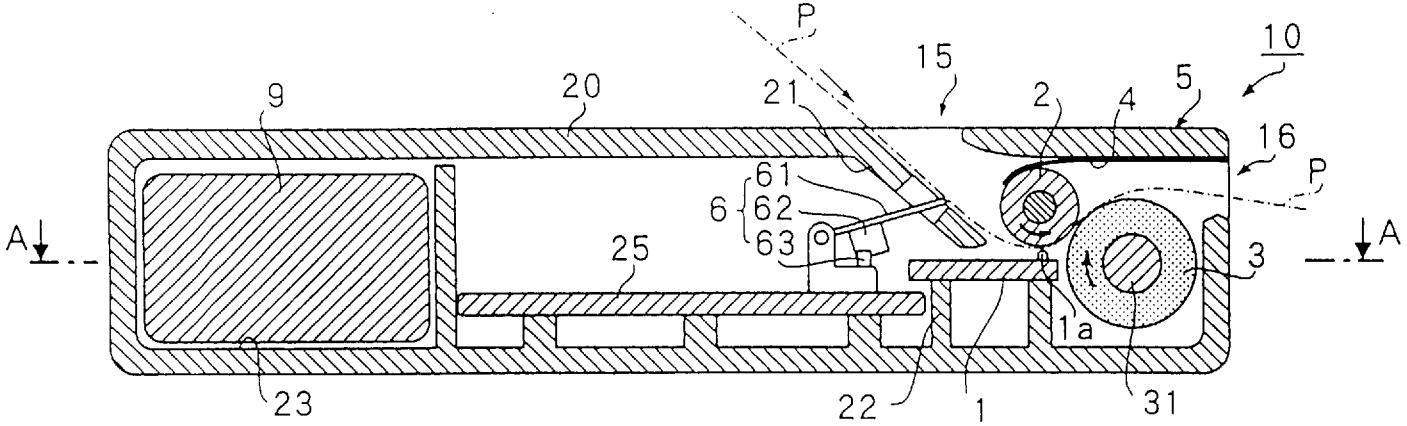
FIG. 2 is a side sectional view of the thermal line printer shown in FIG. 1.

FIG. 2 shows a side sectional view of the printer 10. The printer includes a thermal line head 1 provided with a plurality of heat generating resistors 1*a* which are selectively heated in accordance with image data. A platen roller 2 which presses the recording paper P together with the thermal head line 1 at a predetermined pressure. A carriage roller 3 rotates to feed the recording paper P, received in a housing 20. A control substrate 25 is provided in the housing 20 near the center thereof to control the printing operation. A battery compartment 23 is formed in the rear portion (left portion in FIG. 2) of the housing 20, in which a battery 9 is installed.

The housing 20 is provided with a guide slope 21 which is inclined toward the thermal line head 1 to guide the recording paper P from the insertion opening 15 to the thermal line head 1. A detector 6 positioned on the control substrate 25 near the guide slope 21 and the thermal line head 1 includes a swing lever 61 which protrudes from the guide slope 21 into the passageway of the recording paper P, a shutter plate 62 secured to the swing lever 61, and a photosensor 63 provided below the shutter plate 62, to detect the insertion of the recording paper P.

The thermal line head 1 is provided with an array of heat generating elements (e.g., resistors) 1*a* arranged along a line perpendicular to the feeding direction of the recording paper P. The thermal line head 1 is secured to support posts 22 provided on the bottom of the housing 20 so that the heat generating resistors 1*a* face upward.

The platen roller 2 opposed to the thermal line head 1 is made of a relatively hard material, such as epoxy resin or phenol resin. The platen roller 2 is rotatably supported by a swing cover 5 which is in turn rotatably or swingably attached to the housing 20. The carriage roller 3, which is located below the platen roller 2, is made of a rubber roller and located close to the thermal line head 1. The shaft 31 at the center of carriage roller 3 is driven by a drive system, which will be discussed hereinafter.

Figure 3:
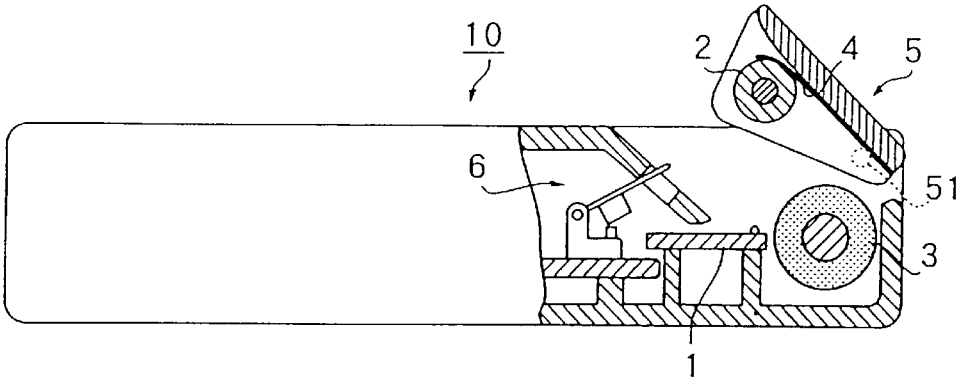
FIG. 3 is a partial side sectional view of a thermal line printer shown in a position different from FIG. 2.

FIG. 3 shows a side sectional view of the printer 10 when the swing cover 5 is opened. The swing cover 5 is rotatable with respect to the housing 20 through pivot shafts 51 (FIG. 4) formed on the front end (right end in FIG. 3) thereof. The swing cover 5 is provided with spring members 4 which bias the platen roller 2 downward, i.e., toward the thermal line head 1 and the carriage roller 3.

Figure 4:
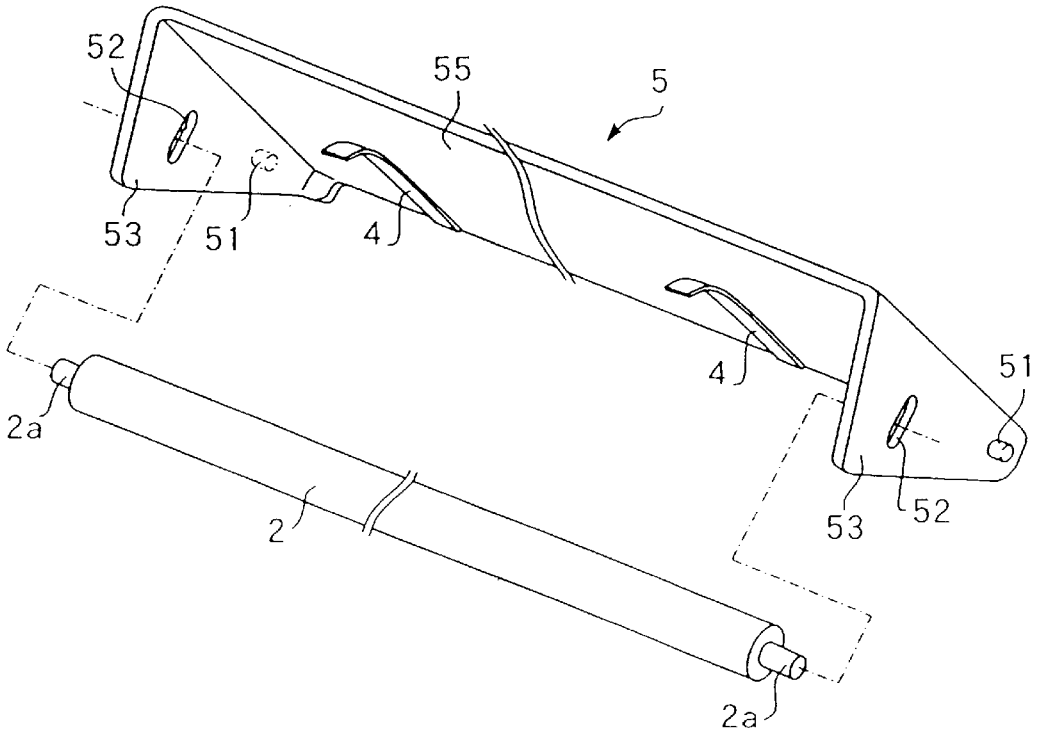
FIG. 4 is a perspective view of a swingable cover.

FIG. 4 shows a perspective view of the swing cover 5. The swing cover 5 includes of a top plate 55 and a pair of side plates 53 which are provided on the front ends thereof with the shafts 51. The swing cover 5 can rotate or swing about the shafts 51 to open and close the swing cover 5 with respect to the housing 20. The side plates 53 are also provided with elongated holes 52 which extend in a direction substantially perpendicular to the axis of the shafts 51. Both ends of the support shaft 2*a* of the platen roller 2 are fitted in the elongated holes 52. The longitudinal direction of the elongated holes 52 is identical to the direction in which the platen roller 2 moves close to or away from the thermal line head 1 and the carriage roller 3 when the swing cover 5 is closed. Namely, the platen roller 2 can move along the elongated holes 52 close to or away from the thermal line head 1 and the carriage roller 3.

The spring members 4 located above the platen roller 2 are elongated leaf springs which are connected at one end to the top plate 55 of the swing cover 5 and abut at the other end against the surface of the platen roller 2 from above. Thus, the platen roller 2 is elastically biased toward the thermal line head 1 at a predetermined pressure due to the elasticity of the spring members 4, as shown in FIG. 2. The platen roller 2 is elastically pressed against not only the thermal line head 1 but also against the carriage roller 3 located adjacent to the thermal line head 1. Note that it is alternatively possible to provide more than two spring members 4 which are spaced in the axial direction of the platen roller 2. In this alternative, the platen roller 2 can be uniformly biased in the axial direction thereof by the spring members 4, so that deflection of the platen roller 2 tends not to occur.

Figure 5:
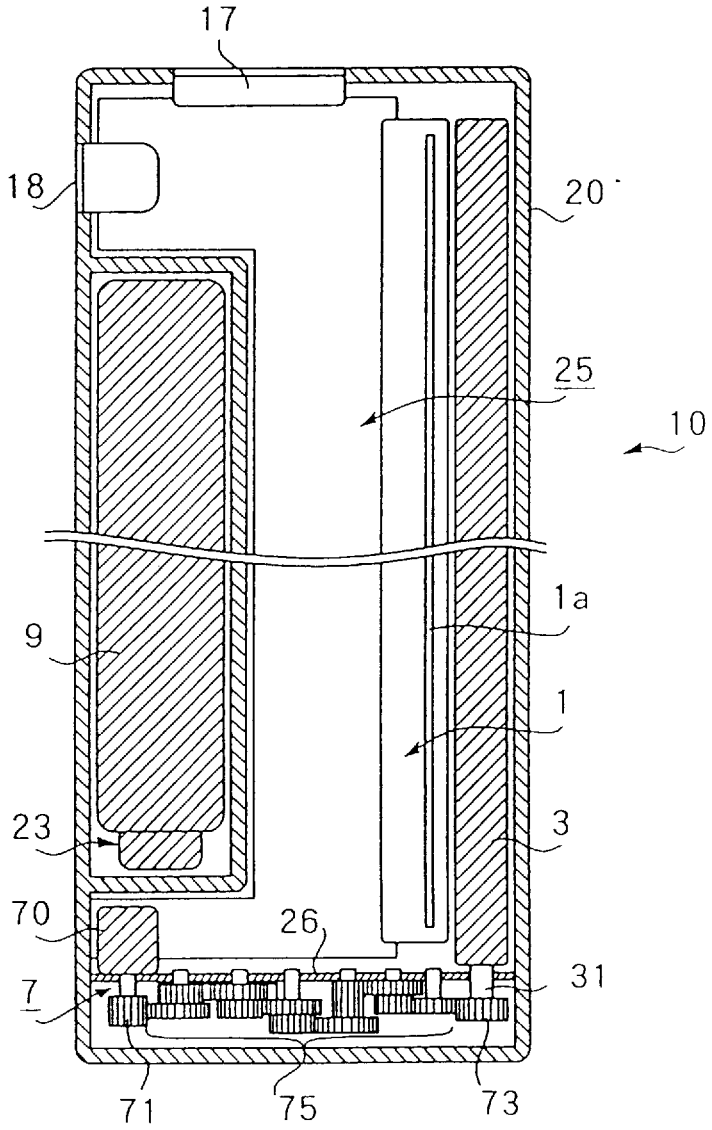
FIG. 5 is a plan view of an internal structure of the thermal line printer shown in FIG. 1.

FIG. 5 shows a sectional view of the printer 10, taken along the line A—A in FIG. 2. In FIG. 5, a panel 26 is provided at one end of the housing 20 (lower end in FIG. 5), to serve as a mounting surface for the drive system 7 which drives the carriage roller 3. The panel 26 is provided thereon with a drive motor 70 whose output shaft 71 is connected to a roller gear 73 secured to the shaft 31 of the carriage roller 3 through a gear train 75.

Figure 6A:
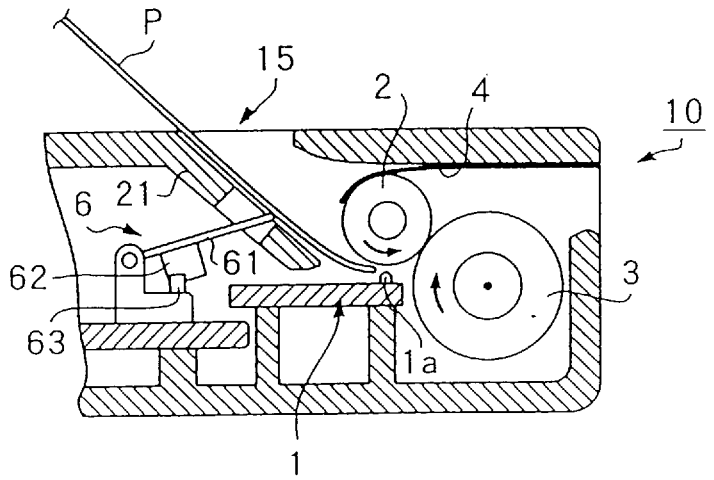
FIGS. 6*a*, 6*b* and 6*c* are side sectional views of a thermal line printer in a different operational position, according to the present invention; and, FIG. 7 is a side sectional view of a known thermal line printer.

The printer 10 constructed as above operates as follows (see FIGS. 6*a* through 6*c*).

The recording paper P is inserted in the housing through the insertion opening 15 formed in the upper surface of the printer body, and is fed along the guide slope 21 provided below the insertion opening 15 into the passageway defined between the thermal line head 1 and the platen roller 2. When the swing lever 61 is swung by the leading end of the recording paper P, the shutter plate 62 interrupts the light path of the photosensor 63 to thereby detect the insertion of the recording paper P.

When the presence of the recording paper P is detected by the photosensor 63, the drive motor 70 (FIG. 5) drives the carriage roller 3 to rotate at a constant speed. Since the platen roller 2 is pressed against the carriage roller 3 by the spring members 4, the platen roller 2 is rotated due to the frictional force produced between the surface of the carriage roller 3 and the surface of the platen roller 2 (FIG. 6*a*).

Figure 6B:
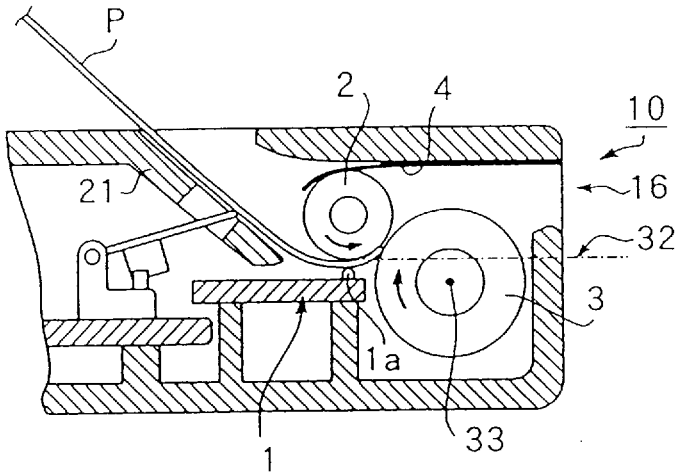
Figure 6C:
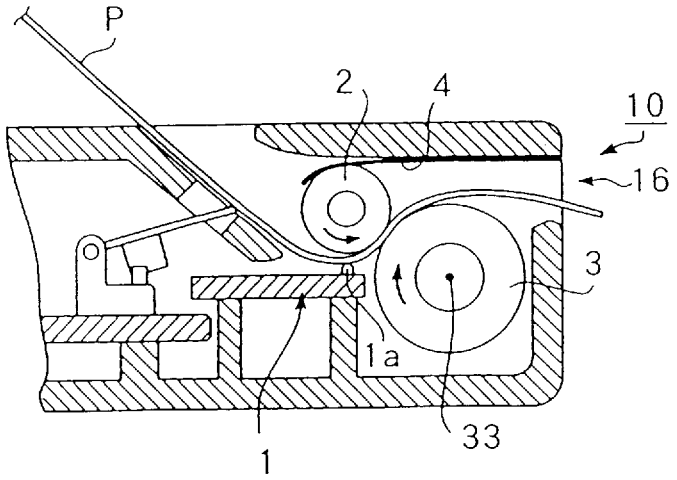
Figure 7:
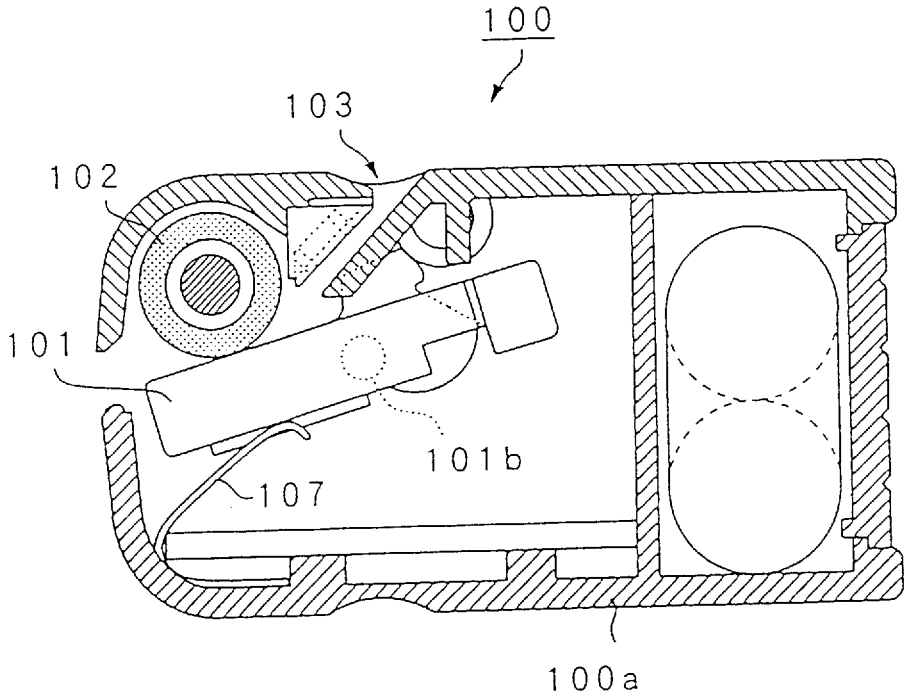
Fig. 7 PRIOR ART

As a result of the rotation of the platen roller 2, the recording paper P passes between the thermal line head 1 and the platen roller 2 while being pressed by the thermal line head 1 and the platen roller 2 at a predetermined pressure (FIG. 6*b*).

In FIG. 6*b*, the center of rotation 33 of the carriage roller 3 is located on the same side as the thermal line head 1 with respect to the tangential line 32 to the platen roller 2 at the point thereof closest to the thermal line head 1. Consequently, the recording paper P which has passed the passageway between the thermal line head 1 and the platen roller 2 abuts against the upper portion of the outer peripheral surface of the carriage roller 3 in FIG. 6*b* at a relatively small angle. Thereafter, the recording paper P is smoothly conveyed into the passageway between the carriage roller 3 and the platen roller 2 in accordance with the rotation of the carriage roller 3.

As can be seen from the foregoing, the recording paper P is fed in accordance with the rotation of the carriage roller 3 and is pressed at a predetermined pressure by the platen roller 2. Consequently, the characters or image data, etc, are printed by the heat generating resistors 1*a* of the thermal line head 1. The recording paper P which has passed between the carriage roller 3 and the platen roller 2 is discharged from the discharge opening 16 (FIG. 6*c*).

The friction coefficient of the surface of the platen roller 2 is smaller than that of the surface of the carriage roller 3. Consequently, the grip force of the carriage roller 3 to hold the recording paper P is stronger than that of the platen roller 2. Hence, the carriage roller 3 contributes to the conveyance of the recording paper P much more than the platen roller 2. This prevents the recording paper P from being irregularly fed.

Moreover, since the friction coefficient of the surface of the platen roller 2 is relatively small, the friction resistance produced between the platen roller 2 and the thermal line head 1 can be reduced if there is no recording paper P between the platen roller 2 and the thermal line head 1. Consequently, the drive torque of the drive motor 70 is reduced accordingly.

When the recording paper P exists between the carriage roller 3 and the platen roller 2, the surface of the platen roller does not directly make contact with the surface of the carriage roller 3. Nevertheless, the rotation of the carriage roller 3 is transmitted to the platen roller 2 through the recording paper P. Thus, the platen roller 2 is rotated in the same way as in the case where the surface of the platen roller directly makes contact with the surface of the carriage roller 3.

As may be understood from the above discussion, according to the present invention, the recording paper P is fed chiefly by the carriage roller 3, and the platen roller 2 mainly functions to press the recording paper P. Consequently, it is not necessary that the platen roller 2 be made of rubber. Namely, the platen roller 2 can be made of hard plastic or the like, and hence it is possible to decrease the diameter of the platen roller 2 without causing a problem with the deflection of the platen roller. Moreover, the carriage roller 3 which is made of a rubber roller or the like has a relatively large diameter, but it is not necessary to oppose the carriage roller 3 to the thermal line head 1. Therefore, the thermal line printer can be made thin as a whole.

What is claimed is:

1. A thermal line printer in which image data is printed on a recording paper using a thermal line head having an array of generating elements said printer comprising:

a platen roller opposed to said thermal line head, said platen roller applying pressure to said thermal line head;

a carriage roller provided in proximity to said thermal line head, said carriage roller contacting said platen roller, a center of rotation of said carriage roller being located on a same side as said thermal line head with respect to a tangential line to said platen roller at a point closest to said thermal line head; and a drive system which drives said carriage roller, said recording paper being fed through a passageway defined between said thermal line head and said platen roller in accordance with rotation of said carriage roller by said drive system;

wherein said recording paper passes through a further passageway defined between said carriage roller and said platen roller.

2. A thermal line printer according to claim 1, further comprising a biasing system that biases said platen roller toward said thermal line head and said carriage roller, said recording paper being pressed at a predetermined pressure between said platen roller and said thermal line head, and between said platen roller and said carriage roller.

3. A thermal line printer according to claim 2, wherein said biasing system includes at least one spring member.

4. A thermal line printer according to claim 3, wherein said spring member abuts against and presses said surface of said platen roller.

5. A thermal line printer according to claim 1, wherein said carriage roller is located downstream of said thermal line head, along a feeding direction of said recording paper.

6. A thermal line printer according to claim 1, wherein a coefficient of friction of a surface of said platen roller is smaller than that of a surface of said carriage roller.

7. A thermal line printer according to claim 1, wherein said platen roller is made of plastic.

8. A thermal line printer according to claim 1, wherein said platen roller is supported by a swing cover which is swingable with respect to a body of paid printer.

9. A thermal line printer according to claim 8, wherein said swing cover includes a pair of side plates, each having an elongated hole extending in a direction in which said swing cover moves toward and away from said thermal line head and said carriage roller, and wherein said platen roller is provided with a support shaft having ends fitted in said elongated holes of each of said pair of sideplates.

10. A thermal line printer according to claim 9, further comprising at least one spring member which is secured at one end to said swing cover and which abuts against said surface of said platen roller at the other end.

11. A thermal line printer according to claim 9, further comprising spring members which are spaced in the axial direction of said platen roller where each spring member is secured at one end to said swing cover and which abut against said surface of said platen roller at the other end.

12. A thermal line printer according to claim 8, wherein said swing cover is provided at one end, with a pivot shaft downstream of said thermal line printhead in a feeding direction of said paper, and wherein the platen roller is located upstream in said feeding direction with respect to said pivot shaft.

13. A thermal line printer according to claim 1, further comprising an insertion opening through which the recording paper is inserted in the printer, and a guide member disposed between said thermal line head and said insertion opening which guides the recording paper to said thermal line head and said platen roller.

14. A thermal line printer according to claim 13, further comprising a detecting system that detects the passage of said recording paper through said guide member.

15. A thermal line printer according to claim 14, wherein said drive system rotates said carriage roller to feed the recording paper to pass through said passageway when said detecting system detects said recording paper passing over said guide member.

16. A thermal line printer in which image data is printed on a recording paper using a thermal line head having an array of heat generating elements, comprising:

a platen roller opposed to said thermal line head and applying pressure to said thermal line head;

a carriage roller positioned proximate to said thermal line head and contacting said platen roller; and a drive system that drives said carriage roller, said recording paper being fed through a passageway defined between said thermal line head and said platen roller in accordance with rotation of said carriage roller by said drive system;

wherein a center of rotation of said carriage roller is located on a same side as said thermal line head with respect to a line tangential to said platen roller at a point closest to said thermal line head.

17. A thermal line printer in which image data is printed on a recording paper using a thermal line head having an array of heat generating elements, comprising:

a platen roller opposed to said thermal line head and applying pressure to said thermal line head;

a carriage roller positioned proximate to said thermal line head and contacting said platen roller; and a drive system which drives said carriage roller, said recording paper being fed through a passageway defined between said thermal line head and said platen roller in accordance with rotation of said carriage roller by said drive system;

wherein said platen roller is supported by a swing cover which is swingable with respect to a body of said printer;

said swing cover being provided, at an end positioned downstream along a paper feeding direction, with a pivot shaft, said platen roller being located upstream in the paper feeding direction with respect to said pivot shaft.

18. A thermal line printer in which image data is printed on a recording paper using a thermal line head having an array of heat generating elements, said printer comprising:

a platen roller opposed to said thermal line head, said platen roller applying pressure to said thermal line head, said platen roller being held by a swing cover which is swingable with respect to a body of said printer, said swing cover being provided, at one end, with a pivot shaft positioned downstream of said thermal line print head in a feeding direction of said paper, said platen roller being located upstream in said feeding direction with respect to said pivot shaft;

a carriage roller provided in proximity to said thermal line head, said carriage roller contacting said platen roller; and a drive system which drives said carriage roller, said recording paper being fed through a passageway defined between said thermal line head and said platen roller in accordance with rotation of said carriage roller by said drive system;

wherein said recording paper passes through a further passageway defined between said carriage roller and said platen roller.

19. The thermal line printer according to claim 18, further comprising a biasing mechanism, said biasing mechanism biasing said platen roller with respect to said thermal line head and said carriage roller, said recording paper being pressed at a predetermined pressure between said platen roller and said thermal line head and between said platen roller and said carriage roller.

20. The thermal line printer according to claim 19, said biasing mechanism comprising at least one spring member.

21. The thermal line printer according to claim 20, said at least one spring member abutting against and pressing a surface of said platen roller.

22. The thermal line printer according to claim 18, said carriage roller being located downstream of said thermal line head, along a feeding direction of said recording paper.

23. The thermal line printer according to claim 18, wherein a coefficient of friction of a surface of said platen roller is smaller than a coefficient of friction of a surface of said carriage roller.

24. The thermal line printer according to claim 18, wherein said platen roller is made of a hard plastic material.

25. The thermal line printer according to claim 18, said swing lever including a pair of side plates, each of said side plates having an elongated hole extending in a direction in which said swinging cover moves towards and away from said thermal line head and said carriage roller, said platen roller being provided with a support shaft having ends fitted in said elongated holes of each of said pair of side plates.

26. The thermal line printer according to claim 25, further comprises at least one spring member secured at one end to said swing cover and abutting against said surface of said platen roller at said other end.

27. The thermal line printer according to claim 25, further comprising spring members which are spaced along an axial direction of said platen roller, each spring member being secured at one end through said swing cover and abutting against said surface of said platen roller at another end.

28. The thermal line printer according to claim 18, further comprising an insertion opening through which said recording paper is inserted into the printer, and a guide member provided between said thermal line head and said insertion opening to guide said recording paper to said thermal line head and said platen roller.

29. The thermal line printer according to claim 28, further comprising a detecting mechanism, said detecting mechanism detecting passage of said recording paper through said guide member.

30. The thermal line printer according to claim 29, wherein said drive system rotates said carriage roller to feed said recording paper to pass through said passageway between said thermal line head and said platen roller when said detecting mechanism detects said recording paper passing over said guide member.

* * * * *

UNITED STATES PATENT AND TRADEMARK OFFICE

CERTIFICATE OF CORRECTION

PATENT NO. : 5,876,129

DATED : March 2, 1999

INVENTOR(S) : M SUZUKI

It is certified that error appears in the above-identified patent and that said Letters Patent is hereby corrected as shown below:

At column 6, line 24 (claim 1, line 3) of the printed patent, after "elements" insert --- , ---.

At column 6, line 64 (claim 8, line 3) of the printed patent, "paid" should be ---said---.

Signed and Sealed this

Twenty-eighth Day of March, 2000

*Attest:*

Q. TODD DICKINSON

*Attesting Officer*

*Commissioner of Patents and Trademarks*